United States Patent [19]

Louis

[11] 4,024,689

[45] May 24, 1977

[54] SECTIONAL JOINT AND SLAB FROM CAST MATERIAL

[76] Inventor: Pierre Alexandre Georges Louis, 27 rue Robert de Flers, 75015 Paris, France

[22] Filed: Oct. 16, 1975

[21] Appl. No.: 623,065

[52] U.S. Cl. ..... 52/396; 404/68; 404/67

[51] Int. Cl.[2] ..... E04B 1/62

[58] Field of Search ..... 52/396; 404/68, 47, 404/67

[56] References Cited

UNITED STATES PATENTS

| | | | |
|---|---|---|---|
| 1,824,715 | 9/1931 | Galassi | 404/67 |
| 2,060,274 | 11/1936 | Awbrey | 404/67 |
| 2,099,517 | 11/1937 | Hayes | 404/47 |
| 2,120,725 | 6/1938 | Zanin | 404/67 |
| 2,278,023 | 3/1942 | Robertson | 404/67 |
| 3,059,553 | 10/1962 | Woolley | 404/68 |
| 3,385,017 | 5/1968 | Williams | 52/396 |
| 3,745,726 | 7/1973 | Thom | 404/47 |
| 3,750,355 | 8/1973 | Blum | 52/396 |
| 3,826,583 | 7/1974 | Pare | 404/67 |
| 3,904,302 | 9/1975 | Bertschmann | 404/68 |

*Primary Examiner*—Price C. Faw, Jr.
*Assistant Examiner*—Robert C. Farber

[57] ABSTRACT

A sectional joint for making surfaces from a cast material such as concrete, and a slab made therefrom. These consist of a strip or web with two faces, each face being formed with projecting portions and depressed portions which respectively extend into the cast material or are filled by the cast material.

8 Claims, 8 Drawing Figures

Fig. 3.
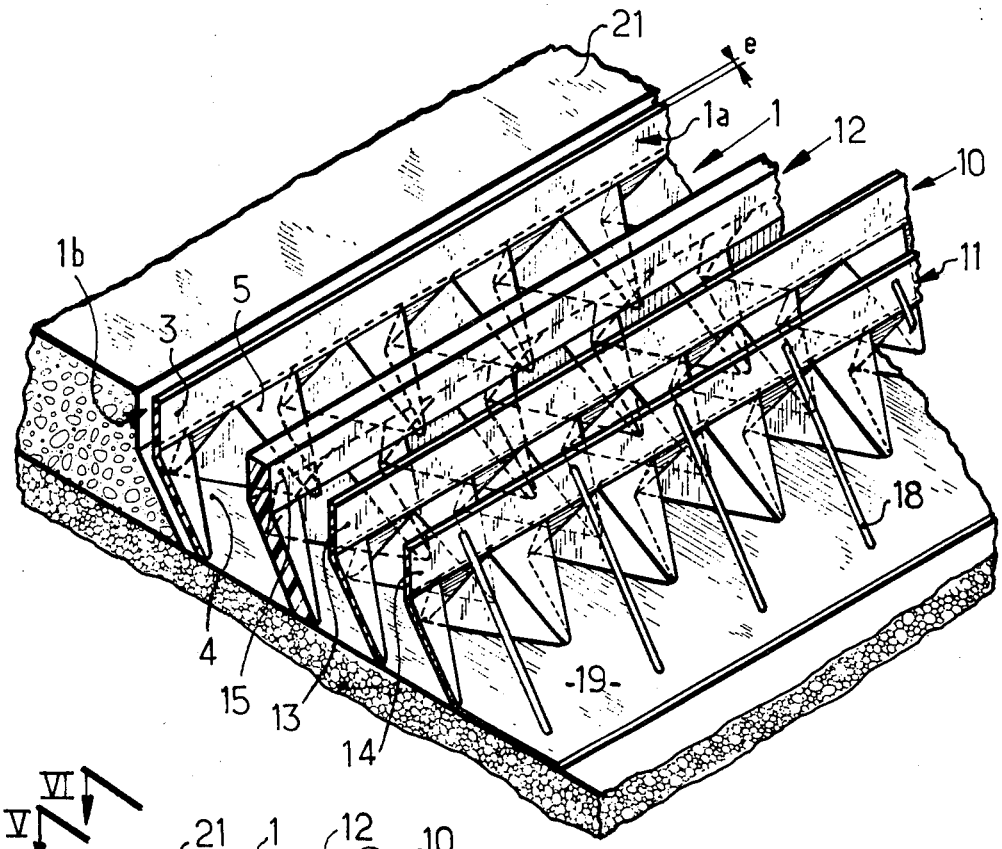
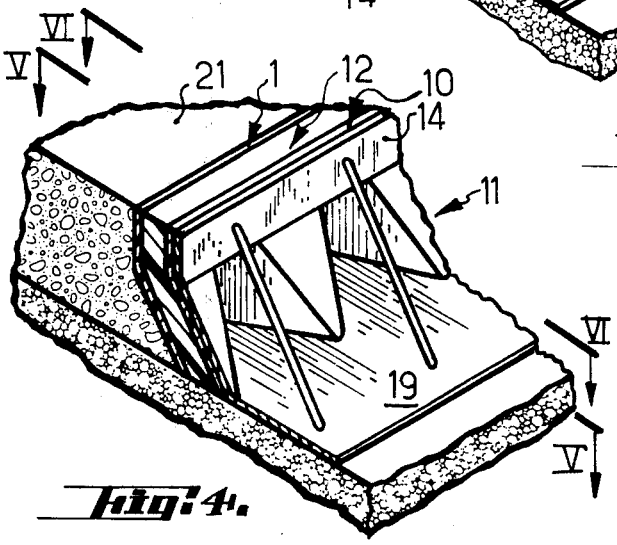
Fig. 4.
Fig. 1.
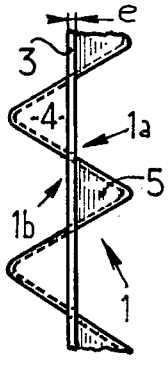
Fig. 2.
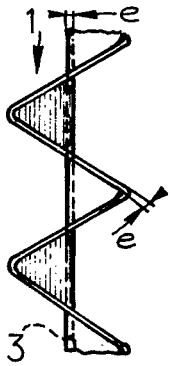

SECTIONAL JOINT AND SLAB FROM CAST MATERIAL

The present invention relates to the making of surfaces or flaggings, floorings or pavings from cast material such as concrete. Heretofore the building of such flaggings could be carried out by casting, working or placing concrete or any other material inside of shutterings, formworks of like casings or framings constituted by suitably arranged casting rulers or like bars. Such a system of casting rulers suffers from various inconveniences in particular during the stripping, releasing or removing step and when cleaning them. To overcome such inconveniences it is known to make use of casting rulers adapted to be embedded into the mass or body of concrete, i.e. usable as a sacrifice shuttering or formwork.

Such rulers incorporated into the concrete may thus serve as joints between any two juxtaposed slabs or plates. A drawback of the sacrifice shutterings or formworks proposed by the prior art is due to causing the overhang of one part of the concrete of the slab which bears upon the ruler and not on the concrete itself thereby resulting in a homogeneity defect of the flagging or slabbing.

The present invention provides a sectional or shaped joint overcoming all these inconveniences. It provides a joint consisting essentially of a web comprising two faces, each face formed with raised or projecting portions and with depressed or recessed portions which extend into the cast material or are filled with said cast material, respectively.

Such sectional or shaped joints enable to make the casting frames or casings for the manufacture of slabs the edges of which comprise projecting or raised parts and recessed or depressed parts that may co-operate respectively with the recessed or depressed parts and the raised parts or protrusions of other slabs of the same kind which are juxtaposed thereto so as to interlock them in strictly mating relationship. Thus through the agency of one single thickness of the joint-forming web the concrete of one slab will rest on the concrete of another slab.

According to one form of embodiment of the sectional joint provided by the present invention, the web may exhibits an outer flat ridge without any hollows or porjections on each face, which ridge is extended by the depressed portions and projections for the remainder of the web. This ridge, when it is located above the depressed portions and projections, enables to achieve a substantially straight slab top thereby giving the slabbing or flagging thus formed a conventional appearance. On the other hand this ridge provides a connection between the hollow deformed or recessed portions and projections of the web and prevents the latter from being deformed further or later.

The invention will be better understood and further objects, characterizing features, details and advantages thereof will appear more clearly as the following explanatory description proceeds with reference to the accompanying somewhat schematic drawings given by way of nonlimiting examples, only illustrating several presently preferred forms of embodiment of the invention, and wherein :

FIG. 1 is a top view of a sectional joint with an upper ridge;

FIG. 2 is a bottom view of this same joint;

FIG. 3 is an exploded perspective view of a device for using the sectional joint shown in FIGS. 1 and 2;

FIG. 4 shows a detail of the perspective view of the working device shown in FIG. 3;

Figure 5:
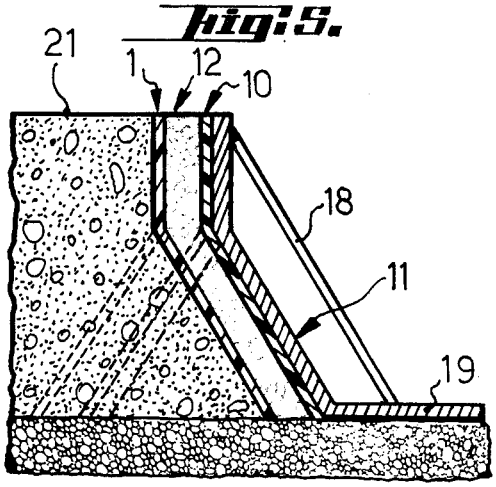
FIG. 5 is a view in partial cross-section taken upon the line V—V in FIG. 4.
Figure 6:
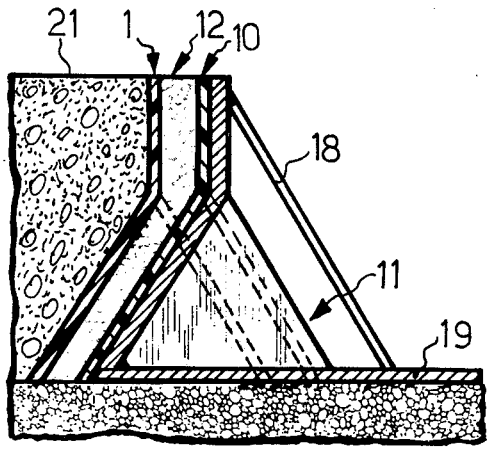
FIG. 6 is a view in partial cross-section taken upon the line VI—VI in FIG. 4.

Referring now in detail to the drawings and more particularly to FIGS. 1, 2 and 3, a sectional or shaped joint 1 corresponding to the form of embodiment shown consists of a web or strip with a thickness *e* comprising a straight flat upper ridge 3 and a deformed lower portion exhibiting recessed or depressed parts 4 on either face 1*a*, 1*b* and raised or projecting parts 5 as shown in particular on the face 1*a* of the sectional member 1 seen in FIG. 3. The hollow or recessed portions 4 and projections 5 have arch-like walls caused to bear on the ground and already imparting some strength to the sectional member.

For carrying out surfaces made from cast material such as concrete an exemplary process consists in positioning the sectional joint onto the ground and casting the concrete from one and/or the other side of the joint either successively or siumltaneously.

The slabbings thus carried out by means of the sectional members according to the present invention consist of juxtaposed slabs tightly interlocked with each other in mating relationship owing to the co-operation of the hollow or recessed portion and projection of their respective edges.

It is possible for slabs thus embedded or set to move vertically or sidewise with respect to each other thereby providing high stability to the slabbing achieved. Such concrete slabbings or flaggings are thus able to sustain significant local stresses without any strain or deformation, for instance in the case of accelerating or braking heavy vehicles such as aircrafts on airports.

On the other hand the casting proper of the slabs is facilitated by a joint such as that according to the present invention. Indeed when the joint remains embedded in the body of cast concrete it enables to avoid any cleaning or lubricating operation as well as any possibility of deformation or strain of the slab upon stripping, dismantling or removing the shuttering or formwork, which removal becomes useless.

The inventive sectional joint may be made from plastics material, rubber or any other stiff or flexible or yielding material usable for such supports, adapted to be embedded into a concrete slabbing or to be withdrawn therefrom. The configuration of the sectional member may be quite different in the shapes of the hollow or recessed portions and projections as well as in the position of the flat portion; thus for instance the flat portion may be provided at the lower part of the joint instead of being located at its upper part; on the other hand this flat portion, when it forms the upper ridge, instead of having an outer straight edge, may as well have an edge substantially in the shape of a concave or convex curve.

In such a case it is for instance possible to make use thereof for building bulged or cambered concrete surfaces, in particular in the case of embanked roads or also in the case of a sudden sag or water splash or of a hump or high-crowned road purposely provided on the roads with a view of limiting the speeds of vehicles or cars.

Figure 7:
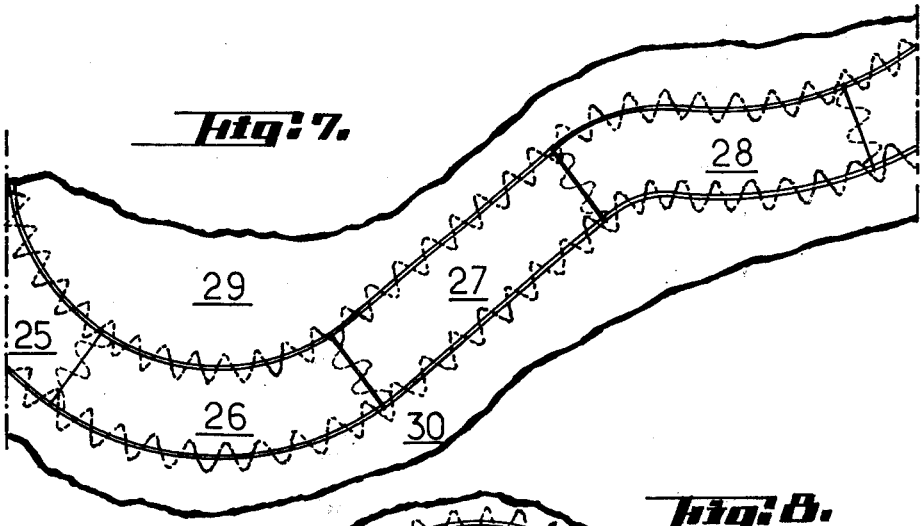
FIG. 7 is a top view of a slabbing or flagging carried out by means of more or less curved sectional members.
Figure 8:
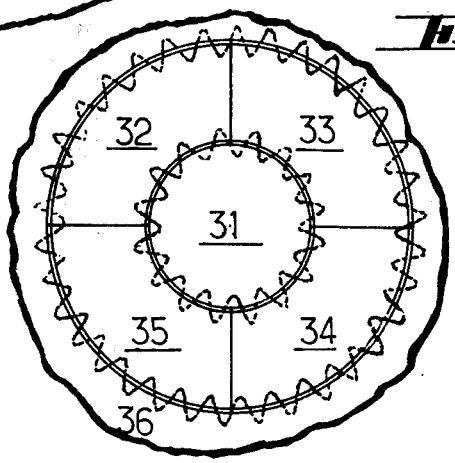
FIG. 8 is a top view of another embodiment of a slabbing or flagging carried out by means of the sectional member according to the invention.

According to an alternative embodiment of the sectional joint the flat outer ridge may also be curvilinear, thereby entailing the curvature of the whole joint; it is thus possible to carry out the slabbings such as those shown in FIG. 7 and in FIG. 8.

Thus in FIG. 7 are shown four slabs 25, 26, 27, 28 bounded by sectional members according to the invention and forming a passage-way or path between concrete border areas 29, 30.

In FIG. 8 has been shown a slabbing consisting of slabs 31 to 35 arranged according to a centered pattern in a concrete surface 36, the slabs 31 to 35 being connected and interlocked with each other owing to the use of sectional members on their edges, of the kind described hereinabove.

It is besides also possible, in particular when it is desired to provide curvilinear paths such as those shown in FIG. 7, to bend the sectional joints according to any desired curvature and to lock or hold them against motion in the desired positions on the ground.

It should be noted that different devices for working or applying such a sectional joint may be used in making such concrete surfaces. Thus the sectonal joint according to the present invention may be reinforeced or stiffened with a ruler mechanically strong enough and caused to bear against the face of the joint on at least several distinct points as will be described in detail hereinafter.

FIG. 3, 4, 5 and 6 show a device for particularly using the inventive sectional joint. The joint 1 previously described is associated with another similar sectional joint 10 reinforced with a casting ruler 11; between the two joints 1 and 10 is interposed an expansion joint or packing 12; these four elements 1, 10, 11, 12 are shaped substantially in the same manner and respectively comprise upper ridges 3, 13, 14 and 15 and lower hollow or recessed and projecting portions interfitted with each other. Supports or struts 18 bearing upon the base flange 19 of the ruler 11 strengthen the ruler through buttressing or staying upon the ridge or web portion 14 thereof. A concrete slab 21 is cast on the other side of the sectional member 1 that is in engagement with its face **1*b***.

The expansion joint or packing 12 is useful upon variations in bulk of the juxtaposed concrete slabs when they are undergoing large variatons in temperature. This joint or packing may be made from polystyrene, neoprene, polyethyllene as well as from tar-lined paper or paper with occluded air bubbles or still from any other suitable material.

It is also possible to use the expansion joint 12 independently of the two thin joints 1 and 10.

The casting ruler used may also have any other shape enabling it to bear against one face of the joint on at least several distinct points. It is generally made from a material providing some flexibility to the ruler for instance from steel, aluminum or laminated platsics; this enables to impart any desired curvature to it when forming slabbings of various shapes. It may also bear directly onto the sectional member without the interposition of the expansion joint. On the other hand it may be formed with recesses or snugs capable of keeping the joint properly in position when pouring, placing or working the concrete. Such embeddable snugs may be welded, screwed or riveted onto the ruler.

The ruler may also be advantageously used when casting concrete slabs separated or spaced from each other by one single sectional joint such as 1. In such a case the ruler will reinforce the sectional member at the time of casting the concrete against one face, for instance **1*b* of the sectional member, and after at least partial setting of the concrete the ruler is withdrawn and concrete is cast on the other side of the sectional member in contacting relationship with its face 1*a***.

It should also be noted that by the use of casting frames the sides of which are shaped like the sectional member previously described it is possible to obtain slabs prefabricated from cast material such as concrete, the edges of which exhibit raised or projecting portions and hollow or depressed portions likely to co-operate respectively with hollow or depressed portions and raised or protruding portions of other slabs of the same kind so as to be tightly interlocked in intefitting relationship with each other.

The invention should of course not at all be limited to the forms of embodiment described and shown which have been given by way of example only. In particular it comprises all the means constituting technical equivalents of the means described as well as their combinations if the same are carried out according to its spirit and scope.

What is claimed is:

1. An improved sectional joint for obtaining slabs made from cast material comprising a web having two faces, each face being provided with projecting and with recessed portions, wherein said web has a flat outer ridge devoid of any depression or projection on each face, said ridge being extended for the remainder of said web by said projecting and said recessed portions having arch-like walls adapted to bear upon the ground by a base-line having an undulating shape to ensure the holding of the web.

2. A sectional joint according to claim 1, wherein the said base-line is undulated so that the sum of the distances of the tops of two consecutive projecting portions to the surface of the flat outer ridge of the web is about equal to the height of said web.

3. A sectional joint according to claim 1, wherein said flat outer ridge is substantially straight.

4. A sectional joint according to claim 1, wherein said flat outer ridge is curvilinear.

5. A sectional joint according to claim 1, wherein the outer edge of said ridge has a substantially curved configuration.

6. An improved device for using a sectional joint, comprising a mechanically strong ruler to bear against one face of the joint, wherein said ruler has a sectional contour substantially shaped like that of the sectional joint.

7. A device according to claim 6, further comprising an expansion joint substantially shaped like the sectional joint.

8. A slab made from cast material, comprising at least one lateral edge formed with projecting and with recessed portions, wherein said edge comprises an upper flat part devoid of any projection or depression, said flat part being extended, for the remainder of the edge, by said projecting and recessed portions forming archs alternated on both sides and bearing upon the ground by an undulating base line, so that the recessed and projecting portions belonging to the lateral edges of two adjacent slabs are interlocked in strictly mating relationship.

* * * * *

UNITED STATES PATENT AND TRADEMARK OFFICE

CERTIFICATE OF CORRECTION

PATENT NO. : 4,024,689
DATED : May 24, 1977

INVENTOR(S) : LOUIS , Pierre Alexandre Georges

It is certified that error appears in the above-identified patent and that said Letters Patent are hereby corrected as shown below:

After line 4 insert --Claims priority, France, July 18, 1975 75 22610--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*